United States Patent [19]

Neidich

[11] 4,445,747

[45] May 1, 1984

[54] RIB CAGE TERMINAL

[75] Inventor: Douglas A. Neidich, Harrisburg, Pa.

[73] Assignee: E. I. Du Pont de Nemours and Company, Wilmington, Del.

[21] Appl. No.: 400,242

[22] Filed: Jul. 21, 1982

[51] Int. Cl.[3] ..... H01R 13/12

[52] U.S. Cl. ..... 339/256 R; 339/205; 339/258 RR

[58] Field of Search ..... 339/205, 256 R, 256 S, 339/258 RR

[56] References Cited

U.S. PATENT DOCUMENTS 2,499,297 2/1950 Buchanan ..... 173/328

3,763,460 10/1973 Hatschek et al. ..... 339/89

FOREIGN PATENT DOCUMENTS 811272 4/1937 France ..... 339/258 RR 960968 4/1945 France .

1575700 6/1969 France ..... 339/256 R 377930 8/1973 U.S.S.R. ..... 339/258 RR

*Primary Examiner*—Joseph H. McGlynn

[57] ABSTRACT

A female electrical terminal for receiving round or square pins having a rib cage mounted on a spine. The rib cage has at least four pair of curved cantilevered beams attached at one end to the spine and forming an acute angle with the spine.

7 Claims, 4 Drawing Figures

RIB CAGE TERMINAL

DESCRIPTION

1. Technical Field

This invention relates to electrical connectors. More particularly, it refers to a rib cage terminal for use in connecting to round or square pins.

2. Background Art

The prior art is replete with descriptions of terminals used to contact square or round pins. Many of these terminals are effective for their intended purpose. Examples of the terminals can be found in French Pat No. 960,968 and U.S. Pat. Nos. 2,758,291, 3,538,340 and 3,763,460. However, the search continues for improved terminals that are effective and low cost.

SUMMARY OF THE INVENTION

I have designed a novel low cost female terminal, extremely effective for contacting round or square pins. My terminal has an electrically conducting rib cage mounted on a spine. The rib cage has at least four pair of ribs in the form of curved cantilevered beams, each beam attached at one end to the spine and spaced apart at its other end from a corresponding beam. Each beam is at an acute angle with respect to the spine. The diameter of the rib cage is sufficient to receive round or square pins from other electrical devices. The spine also has mounting tabs at each end extending in a direction away from the rib cage.

BRIEF DESCRIPTION OF THE DRAWINGS

The present invention may be best understood by those having ordinary skill in the art by reference to the following detailed description when considered in conjunction with the accompanying drawings in which:

FIG. 3[B] is a perspective of the same rib cage terminal as in 3[A] after forming.

DETAILED DESCRIPTION OF THE PREFERRED EMBODIMENT

Figure 1:
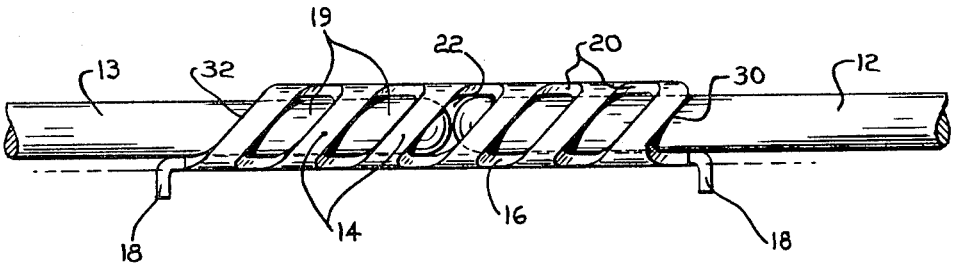
FIG. 1 shows an elevation view of a six rib cage terminal.
Figure 2:
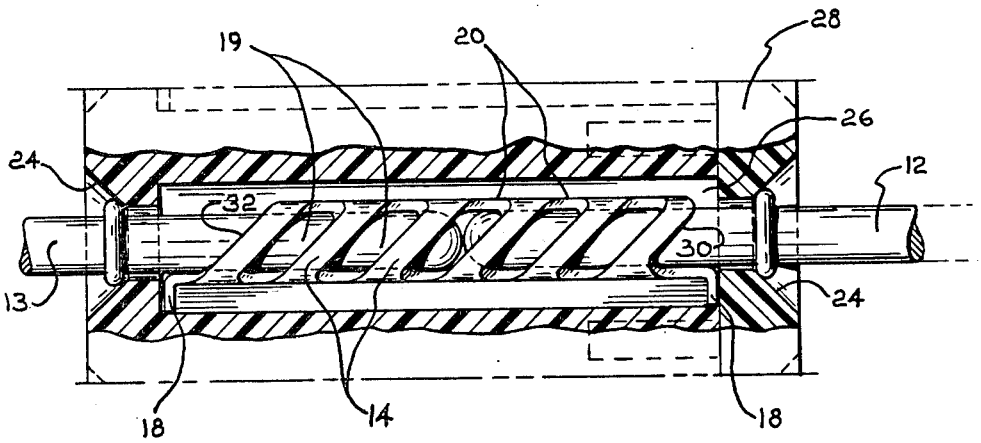
FIG. 2 shows a partial cut away of a connector housing exposing a rib cage terminal with connecting round pins inserted.

Referring to FIG. 1 there is shown a rib cage terminal 10 with pins 12 and 13 inserted. Ribs 14 form an acute angle with regard to the spine 16 of the terminal 10. Mounting tab 18 assists in maintaining the position of the terminal 10 within a housing 28 as seen in FIG. 2. Slots 19 separate the ribs. A rib bridge 20 separates the top of each rib 14. Separate pins 12 and 13 are inserted from each end of the terminal 10. The sloped terminal faces 30 and 32 of the ribs 14 receive the terminal pins

12 and 13 respectively after the pins have passed through the channel 26 in the housing. Chamfered edges 24 in the housing 28 maintain easy entry of the pins 12 and 13. A central opening 22 within the inside space of the rib cage receives the pins 12 and 13. The pins are of such a diameter as to slightly spread the ribs 14 during insertion. The ribs 14 contract after withdrawal of the pins.

Figure 3A:
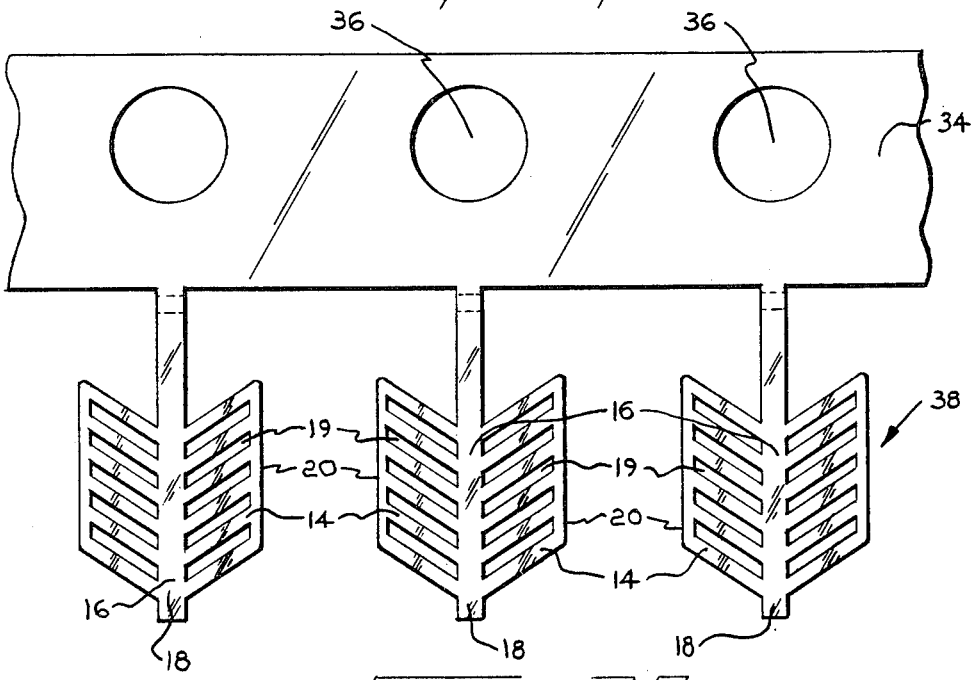
FIG. 3[A] is a perspective of the rib cage terminal on a carrier strip after being stamped from flat metal stock and before forming.
Figure 3B:
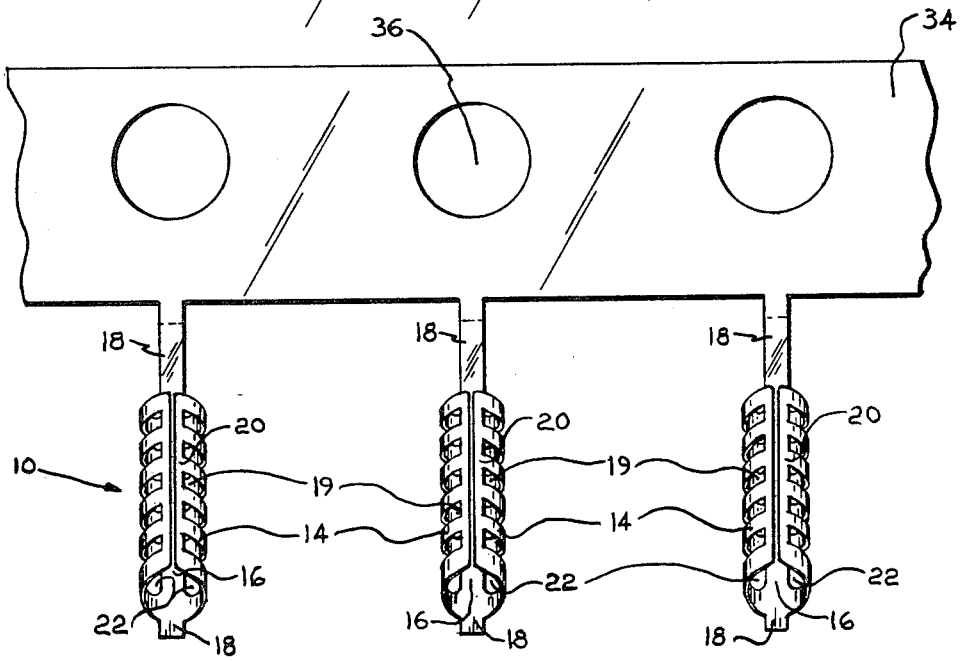

As can be seen in FIG. 3B, the ribs 14 are curved from the spine 16 in an upward direction and are spaced apart from the corresponding rib 14 coming from the other side of the spine 16.

The terminals of this invention can be made from metal flat strip stock as shown in FIGS. 3A and 3B. First, the carrier strip 34 has pilot holes 36 punched therein. Thereafter a stamping press punches out a flat design 38. A forming press turns the ribs 14 so that the configuration shown in FIG. 3B is achieved. The terminal is then removed from the carrier strip and the mounting tabs 18 are formed.

The metal used to form the terminal of this invention can be any one of phosphor-bronze, beryllium-copper, cupro-nickel, other copper alloys, bronze, or other metal commonly used to manufacture terminals.

It is possible to vary the number of ribs 14 in the rib cage. By increasing the number of ribs 14 one increases the total amount of pressure exerted on pins 12 and 13. The minimum number of ribs recommended is four. There is no maximum number except as dictated by cost and the size limitations of the housing.

Having thus described the invention, what is claimed and desired to be secured by Letters Patent is:

1. A female electrical terminal comprising an electrically conducting rib cage mounted on a spine the rib cage having at least four pair of ribs in the form of curved cantilvered beams attached at one end to the spine and spaced apart at its other end from a corresponding beam, each beam being at an acute angle with respect to the spine, the rib cage having a diameter sufficient to accept a round or square pin for electrical termination.

2. A terminal according to claim 1 having a tab on at least one end of the spine extending in a direction away from the rib cage.

3. A terminal according to claim 1 wherein a rib bridge connects the ends of the ribs on each side of the rib cage.

4. A terminal according to claim 1 wherein each beam is aligned with respect to the corresponding beam.

5. A terminal according to claim 1 wherein the rib cage has at least five pair of ribs.

6. A terminal according to claim 1 wherein the rib cage has six pair of ribs.

7. A terminal according to claim 6 having a tab at each end of the spine extending in a direction away from the rib cage.

* * * * *